US010512367B2

(12) United States Patent
Pulvino

(10) Patent No.: US 10,512,367 B2
(45) Date of Patent: Dec. 24, 2019

(54) SYSTEM FOR WASHING AND TREATING NEWBORN INFANTS

(71) Applicant: EFORA DI AIENA NADIA, Palermo (IT)

(72) Inventor: Antonio Pulvino, Palermo (IT)

(73) Assignee: EFORA DI AIENA NADIA, Palermo (IT)

( * ) Notice: Subject to any disclaimer, the term of this patent is extended or adjusted under 35 U.S.C. 154(b) by 0 days.

(21) Appl. No.: 15/761,229

(22) PCT Filed: Sep. 23, 2016

(86) PCT No.: PCT/IB2016/055706

§ 371 (c)(1),
(2) Date: Mar. 19, 2018

(87) PCT Pub. No.: WO2017/051373

PCT Pub. Date: Mar. 30, 2017

(65) Prior Publication Data

US 2018/0255977 A1 Sep. 13, 2018

(30) Foreign Application Priority Data

Sep. 23, 2015 (IT) ..... 102015000054238

(51) Int. Cl.
*A47K 3/064* (2006.01)
*A47K 3/074* (2006.01)
(Continued)

(52) U.S. Cl.
CPC ..... *A47K 3/064* (2013.01); *A47K 3/074* (2013.01); *A61G 11/005* (2013.01); *A61G 11/009* (2013.01); *A61G 12/008* (2013.01); *A61H 33/00* (2013.01); *A47D 9/005* (2013.01); *A61G 7/0005* (2013.01); *A61G 2200/14* (2013.01); *A61G 2203/46* (2013.01); *A61G 2203/80* (2013.01); *A61H 33/0095* (2013.01); *A61H 2033/0008* (2013.01); *A61H 2033/0033* (2013.01); *A61H 2033/0058* (2013.01); *A61H 2201/0161* (2013.01); *A61H 2201/0207* (2013.01); *A61H 2201/0228* (2013.01); *A61H 2201/50* (2013.01); *A61H 2201/5082* (2013.01); *A61H 2203/0456* (2013.01)

(58) Field of Classification Search
CPC ..... A47K 3/064
USPC ..... 4/572.1
See application file for complete search history.

(56) References Cited

U.S. PATENT DOCUMENTS 3,799,228 A 3/1974 Crawford

FOREIGN PATENT DOCUMENTS

DE 41 35 356 A1 4/1993
FR 2093259 A5 1/1972

*Primary Examiner* — Lori L Baker
(74) *Attorney, Agent, or Firm* — R. Neil Sudol; Henry D. Coleman

(57) ABSTRACT

A system for washing and treating infants includes components for keeping an infant under controlled sterile and warm conditions. The system also includes a device for washing the infant, which has a support frame and a flexible laminar element adapted to be secured thereto. The frame and the laminar element define a housing for receiving the infant while he/she is being washed and/or treated. The housing is adapted to be introduced into the washing and treating components and is accessible from outside. The frame has a single-unit structure composed of tubular members made of a medical-grade sterilizable metal or non-metal material.

10 Claims, 2 Drawing Sheets

(51) Int. Cl.

| | |
|---|---|
| ***A61G 11/00*** | (2006.01) |
| ***A61G 12/00*** | (2006.01) |
| ***A61H 33/00*** | (2006.01) |
| ***A47D 9/00*** | (2006.01) |
| ***A61G 7/00*** | (2006.01) |

SYSTEM FOR WASHING AND TREATING NEWBORN INFANTS

FIELD OF THE INVENTION

The present invention generally finds application in the field of medical equipment for infants and particularly relates to a system for washing and treating infants.

BACKGROUND ART

Portable devices have been known to be used for washing infants even when no bathtub or shower is available.

These known devices can be filled with a washing liquid or be connected with appropriate means for continuous feeding of such liquid.

US20080141452 discloses a portable infant washing apparatus having a rigid support that defines a housing for the infant and is adapted to be partially filled with water.

Particularly, the housing comprises a water inlet in fluid communication with common plumbing fixtures via a hose and a water outlet located in the lower portion and also adapted to be connected to a hose.

The infant housing comprises further compartments for storage of products for washing and rinsing the infant, such as cleansers, sponges and towels.

A first drawback of this prior art arrangement is that the apparatus exhibits poor versatility, as the size of the rigid support cannot be adjusted to the size of the infant or to the outer space available for its installation.

Furthermore, the rigid support is quite bulky, involving highly complex transport and displacement of the apparatus.

This drawback prevents use of the apparatus in combination with health care equipment of predetermined size, particularly infant incubators.

Another drawback consists in that, at the end of each washing operation, the cavity of the support must be washed and sterilized to ensure optimal hygiene conditions for further washing operations, which will increase the time required for washing and preparing the infant and will not fully ensure optimal hygiene conditions.

A further drawback is that the housing of the rigid support restricts access by the washing operator as well as the movements of the infant therein, which will further increase the overall washing times.

Yet another drawback is that the supply and drain hoses are quite bulky, and the apparatus will be hardly placed within the interior compartment of the incubator.

Another important drawback is that the washing liquid is only fed through the hose for filling the housing, which will make the infant rinsing operation particularly complex.

US37099228 discloses a portable washing device comprising a support frame and a disposable cloth designed to be removably secured to the frame for housing an infant during washing.

This device has the drawback of having quite large dimensions and of not being suitable for use in washing infants in a warner.

Technical Problem

In view of the prior art, the technical problem addressed by the invention may be deemed to consist in providing a system for washing and treating infants that can be introduced into medical equipment, such as an infant incubator or a warmer, and allow very quick and simple washing and/or treatment operations.

DISCLOSURE OF THE INVENTION

The object of the present invention is to solve the above mentioned technical problem and obviate the above discussed drawbacks, by providing a system for washing and treating infants that is highly efficient and relatively cost-effective.

A particular object of the present invention is to provide a system for washing and treating infants that can be easily used in combination with and within an incubator other similar medical device.

Another object of the present invention is to provide a system for washing and treating infants that involves simple manufacturing and maintenance processes.

Another object of the present invention is to design a system as discussed hereinabove that can be adapted to infants of various sizes.

A further object of the present invention is to provide a system for washing and treating infants that can be easily transported.

A further object of the present invention is to provide a system for washing and treating infants that allows operations on infants to be carried out with a high degree of sterility.

Yet another object of the present invention is to provide a washing system that can be easily assembled on site for use and have very little space requirements when it is not in operation.

These and other objects, as more clearly explained hereafter, are fulfilled by a system for washing and treating infants as defined in claim 1.

This configuration will provide a device with a simple and cost-effective construction that can be easily introduced into the interior compartment of an incubator or another medical device, and can be easily sterilized.

Advantageous embodiments of the invention are obtained in accordance with the dependent claims.

BRIEF DESCRIPTION OF THE DRAWINGS

Further features and advantages of the invention will be more apparent from the detailed description of a preferred, non-exclusive embodiment of a system for washing and treating infants according to the invention, which is described as a non-limiting example with the help of the annexed drawings, in which.

DETAILED DESCRIPTION OF A PREFERRED EXEMPLARY EMBODIMENT

Particularly referring to the figures, numeral 1 generally shows and designates a system for washing and treating infants which is designed to be preferably employed in a hospital or a health care facility, as well as in homes or public places under emergencies.

The present washing system 1 is of portable type and allows an operator to wash or treat an infant N that is temporarily placed in some medical equipment 2 to be kept under controlled warm and sterile conditions.

Particularly, there will be no physical and/or mechanical barriers acting on the operator as he/she washes and treats the infant N, and the latter will not need to be picked up during use of the system 1.

Figure 1:
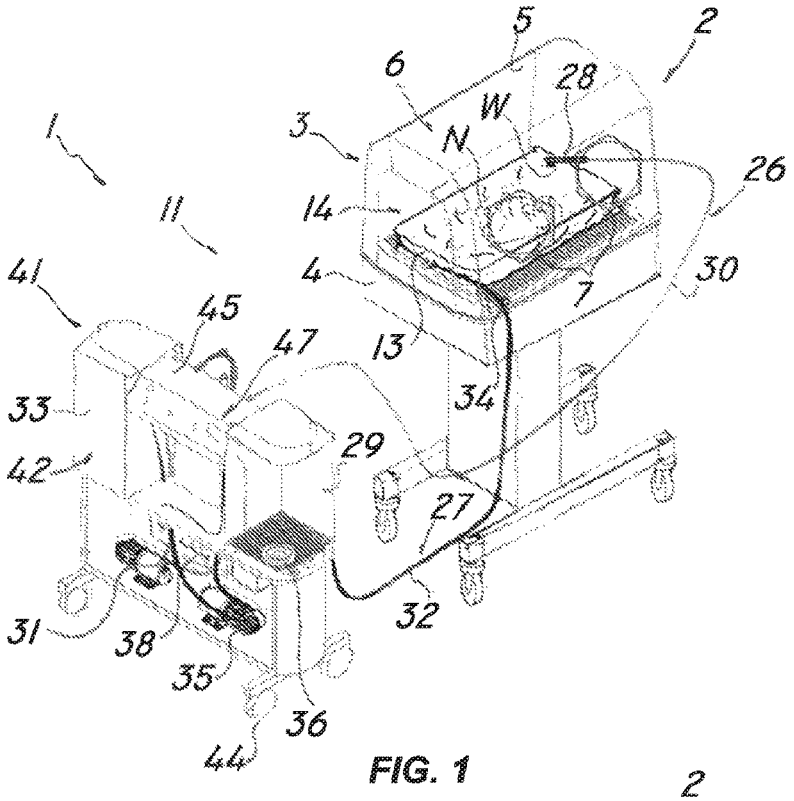
FIG. 1 is a perspective view of the inventive system for washing and treating infants according to a first embodiment.

In a first embodiment, as shown in FIG. 1, the medical equipment 2 of the system 1 may comprise an incubator 3, known per se, basically having a fixed base 4 with a movable cover 5 thereon for delimiting an interior compartment 6 that it generally maintained under controlled conditions, e.g. controlled sterility, for an infant N to be placed therein.

The cover 5 may further comprise a pair of first passages 7 to allow the operator to access the interior of the compartment 6 by his/her hands and act on the infant N.

Figure 2:
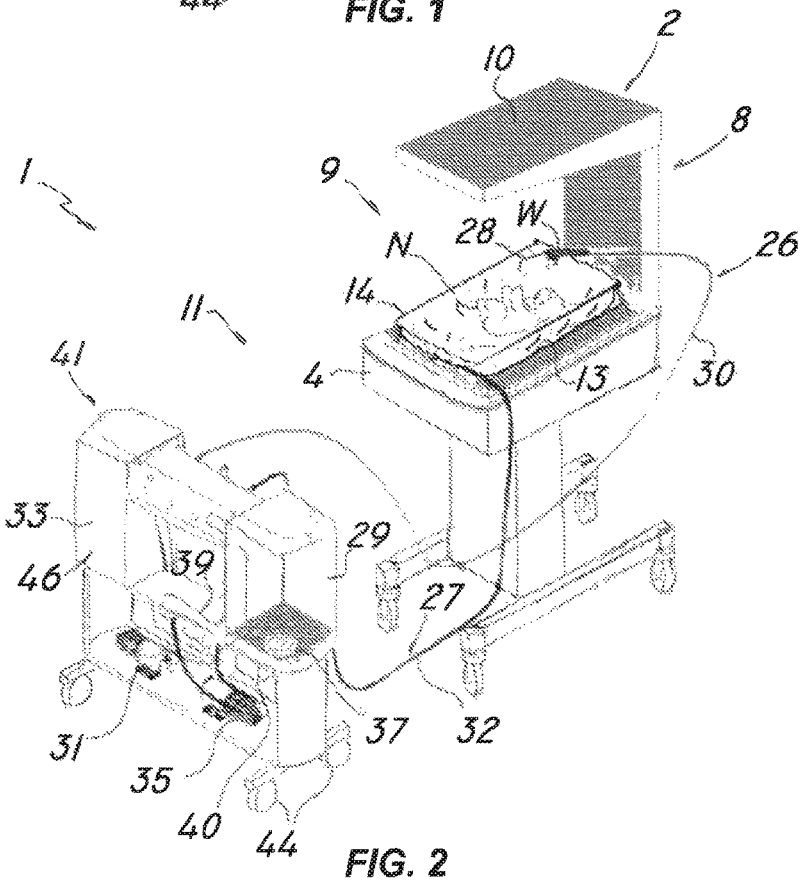
FIG. 2 is a perspective view of the inventive system for washing and treating infants according to a second embodiment.

In a second embodiment of the invention as shown in FIG. 2, the medical equipment 2 of the system 1 may comprise an infant warmer 8 with a fixed base 4 defining a treatment area 9 and a radiant lamp 10 located above the base 4.

The system 1 further comprises a device 11 for washing and treating an infant N, having a support frame 12 and a flexible laminar element 13. The flexible laminar element 13 is adapted to be secured to the frame 12 to define a housing 14 for receiving the infant N while he/she is being washed.

In accordance with a peculiar aspect of the invention, the housing 14 is adapted to be introduced into the medical equipment 2, particularly in the compartment 6 of the infant warmer 8 and to be accessed from outside.

Furthermore, the frame 12 comprises a single-unit structure, which is composed of tubular members 15 made of a medical-grade sterilizable metal or non-metal material.

Possibly, the tubular members 15 may be welded together and have varying thicknesses, for the frame 12 to fit various sizes in predetermined ranges.

Conveniently, the frame 12 may have a substantially rectangular plan shape, defined by a pair of longitudinal tubular members 16, which are designed to rest upon the base 4 of the incubator 3 and the infant warmer 8, and are joined to a pair of raised transverse tubular members 17 via respective substantially vertical posts 18.

Preferably, the longitudinal 16, transverse 17 and vertical 18 members may have lengths of substantially about 61 cm, 35 cm and 13 cm respectively, to support infants that can even have considerably varying sizes.

Figure 3:
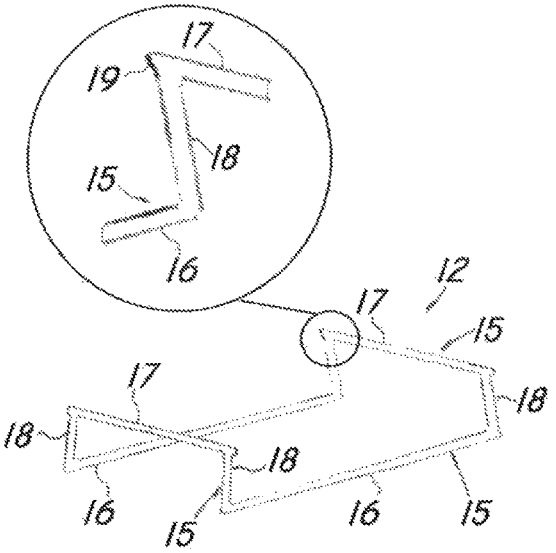
FIG. 3 is a perspective view with a respective enlargement of a first detail of the system.

Conveniently, the transverse tubular members 17 have slightly outwardly projecting ends, as best shown in the enlarged view of FIG. 3, whose purpose will be explained hereinbelow.

Figure 4:
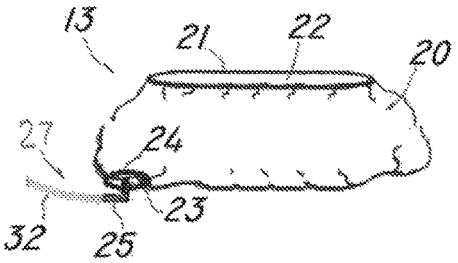
FIG. 4 is a perspective view of a second detail of the system.

Furthermore, the laminar element 13 may consist of a disposable cloth 20, as shown in FIG. 4, made of a medical-grade sterilizable non-woven fabric, and adapted to be coupled to the frame 12.

The cloth 20 may also have a substantially rectangular shape, with larger plan dimensions than the frame 12 and with a peripheral rim 21 that may be folded back onto the frame 12 and attached to the projections 19 for stretching and forming the housing 14 without using clips.

Once the cloth 20 has been mounted to the frame 12, it will have an upper opening 22 with a substantially rectangular or elliptical shape.

Thus, at the end of each washing operation, the operator may easily remove the cloth 20 from the frame 12 by detaching the rim 21 from the projections 19.

The tubular frame 12 may possibly remain within the medical equipment 2 for the operator to removably couple it with a new sterile disposable cloth 2 when one more infant N has to be washed or treated or when further washing or treatment operations have to be carried out throughout the hospital stay of the infant N.

Preferably, the cloth 20 may comprise a lower opening 23 located on the bottom and having a valve 24 and a joint 25 for draining water or another liquid W used for washing the infant N placed in the housing 14.

For easy outflow of the washing liquid W toward the opening 23, the medical-grade fabric of the cloth 20 will be of impermeable type and the base 4 of the medical equipment 2 may be suitably inclined to convey the liquid W toward the opening 23.

The device 11 may further comprise means 26 for distribution of a washing liquid W in the housing 14 and means 27 for draining/discharging the spent liquid W.

The distribution means 26 may comprise a shower dispenser 28 connected to a first reservoir 29 via a first hose 30 and a first pump 31 interposed between the first reservoir 29 and the dispenser 28.

The draining means 27 may comprise a second hose 32 connected to the opening 23 of the cloth 20 via the joint 25 and a second reservoir 33 for collecting the washing liquid W, which is located outside the medical equipment 2.

If the housing 14 is located inside the incubator 2, as shown in FIG. 1, the dispenser 28 may be introduced into the compartment 6 for washing the infant N, through the first passages 7 and the second hose 32 will be adapted to extend through the wall of the cover 5 through a second passage 34 formed therein.

A second pump 35 may be provided between the draining joint 25 and the second reservoir 33, for sucking in the liquid W in the housing 14 while the infant N is being washed.

Advantageously, the valve 24 will prevent any particulate material in the housing 14 from entering the second hose 32 and being sucked in by the second pump 35.

The first pump 31 may have a flow rate of about 7 L/min, to prevent the dispenser 28 from delivering a particularly strong liquid jet of liquid W on the infant N.

The second pump 35 may have a flow rate of bout 9 L/min, for the housing 14 to be emptied in a very short time.

Conveniently, the washing device 11 may further comprise an ozonizer 36 in fluid communication with the first reservoir 29 for sanitization of the washing liquid W.

For example, the ozonizer 36 may comprise an air stone diffuser 37 placed within the first reservoir 29.

Conveniently, the ozonizer 36 may comprise a compressor 38 for generating a stream of compressed air, in fluid communication with the diffuser 37 via a small hose 39.

An appropriate electronic circuit 40 is interposed between the compressor 38 and the diffuser 37 for generating electrostatic charges through the stream of air to generate ozone.

Preferably, the device 11 may comprise a movable unit 41 located outside the medical equipment 2 and adapted to support the first 29 and the second 33 reservoirs, the first 31 and the second 35 pumps and the ozonizer 36.

The movable unit 41 will have a box-like enclosure 42 containing the reservoirs 29, 33, the pumps 31, 35 and the ozonizer 36 and having a bottom wall 43 with wheels 44 for easy displacement thereof around the incubator 3 or the infant warmer 8.

Preferably, the reservoirs 29, 33 have a capacity of about 22 L. This capacity will ensure a sufficient supply of liquid W to the dispenser 28 throughout the process of washing and rinsing the infant N with no refilling.

The enclosure 42 may be made of stainless steel and may have a substantially flat top surface 45 for supporting any accessories for cleansing and drying the infant N.

Furthermore, the outer wall 46 of the movable unit 41 may have a pair of sleeves, not shown, for receiving the hoses 30, 32 connected to the dispenser 28 and the housing 14, manually fitted thereon.

At the end of the process of washing or treating the infant N, the operator may slip the hoses 30, 32 off the respective sleeves and displace the movable unit 41 for emptying the second reservoir 33 and refilling the first reservoir 29 with new washing liquid W.

Advantageously, the device 11 may comprise a sensor and a resistor, not shown, located within the first reservoir 29 for monitoring and regulating the temperature of the washing liquid W before delivery thereof into the housing 14.

The movable unit 41 may further comprise a control panel 47 located in its upper portion and adapted to control the actuation of the pumps 31, 35 and the ozonizer 36.

The control panel 47 may comprise a thermostat 48 connected to the sensor and the resistor located in the first reservoir 29 to monitor and regulate the temperature of the washing liquid W.

The system for washing and treating infants according to this invention is susceptible of a number of changes and variants, within the inventive concept disclosed in the appended claims. For example, the device may comprise a treatment kit, which is also disposable, comprising accessories for cleansing and drying the infant, such as towels, cleansers or the like and accessories for ultrafiltration of the washing liquid.

While the device for washing and treating infants has been described with particular reference to the accompanying figures, the numerals referred to in the disclosure and claims are only used for the sake of a better intelligibility of the invention and shall not be intended to limit the claimed scope in any manner.

INDUSTRIAL APPLICABILITY

The present invention may find application in industry, because it can be produced on an industrial scale in factories for manufacturing devices and accessories for washing infants.

The invention claimed is:

1. A system for washing and treating infants, comprising:

a medical equipment for keeping an infant under controlled sterile and warm conditions;

a device for washing the infant, comprising a support frame and a flexible laminar element adapted to be secured thereto, said frame and said laminar element defining a housing for receiving the infant while he/she is being washed and/or treated;

wherein said flexible sheet member comprises a disposable cloth made of medical grade sterilizable non-woven fabric designed to be coupled to said frame and having dimensions to receive infants of various sizes, wherein said housing is adapted to be introduced into said medical equipment and is accessible from outside said medical equipment, wherein said frame comprises a single-unit or unitary structure of tubular members made of a medical-grade sterilizable metal or non-metal material, wherein said frame has a substantially rectangular plan shape defined by a pair of longitudinal tubular members each joined to a pair of raised transverse tubular members via respective substantially vertical posts, wherein said transverse tubular members have slightly outwardly projecting ends and said cloth has a substantially rectangular shape with larger plan dimensions than said frame and with a peripheral rim folded back onto said frame and attached to said slightly outwardly projecting ends for stretching and forming said housing without use of clips, in such a manner that at the end of each washing operation, an operator may easily remove said cloth from said frame by detaching said rim from said slightly outwardly projecting ends.

2. A system as claimed in claim 1, wherein said medical equipment comprises an incubator having a fixed base with a movable cover for delimiting an interior compartment, said housing being adapted to be introduced into said compartment and to be accessible from outside through said cover.

3. A system as claimed in claim 1, wherein said medical equipment comprises an infant warmer having a fixed base defining a treatment area for positioning the housing and a radiant lamp located above said base.

4. A system as claimed in claim 1, wherein said washing device comprises means for distributing a washing liquid to said housing.

5. A system as claimed in claim 4, wherein said distribution means comprise a shower dispenser connected to a first reservoir for the washing liquid via a first hose.

6. A system as claimed in claim 5, wherein said washing device comprises draining means associated with said laminar element for collecting and draining the washing liquid.

7. A system as claimed in claim 6, wherein said, draining means comprise a second hose connected to a lower opening of said laminar element via an appropriate draining joint and a valve.

8. A system as claimed in claim 7, wherein said second hose is connected to a second collection reservoir external to the medical equipment.

9. A system as claimed in claim 8, further comprising a first pump interposed between said first reservoir and said dispenser for feeding the clean washing liquid, a second pump interposed between said draining joint and said second reservoir for discharging the dirty washing liquid, and an ozonizer that is adapted to be in fluid communication with said first reservoir for sanitizing the washing liquid.

10. A system as claimed in claim 9, further comprising a movable unit located outside the medical equipment for supporting said first and said second reservoirs, said first and said second pumps and said ozonizer, said movable unit being equipped with a control panel for controlling the pumps of the ozonizer and the temperature of the washing liquid.

* * * * *